US008298126B2

(12) United States Patent
Berc

(10) Patent No.: US 8,298,126 B2
(45) Date of Patent: Oct. 30, 2012

(54) SUPPORTING DEVICE FOR A PERSON'S BACK AND HEAD AREA

(76) Inventor: Joachim Berc, Los Angeles, CA (US)

( * ) Notice: Subject to any disclaimer, the term of this patent is extended or adjusted under 35 U.S.C. 154(b) by 0 days.

(21) Appl. No.: 12/931,362

(22) Filed: Jan. 31, 2011

(65) Prior Publication Data

US 2011/0136635 A1 Jun. 9, 2011

Related U.S. Application Data

(63) Continuation-in-part of application No. 12/459,443, filed on Jul. 1, 2009, now abandoned, which is a continuation of application No. 10/520,051, filed as application No. PCT/EP03/06244 on Jun. 13, 2003, now abandoned.

(30) Foreign Application Priority Data

Jul. 2, 2002 (EP) ..... 02400032

(51) Int. Cl.
*A63B 26/00* (2006.01)

(52) U.S. Cl. ..... 482/142; 482/148; 482/907

(58) Field of Classification Search ..... 482/142, 482/148, 907; 5/14, 18.1, 110, 636, 656, 5/601

See application file for complete search history.

(56) References Cited

U.S. PATENT DOCUMENTS

| | | | | |
|---|---|---|---|---|
| 3,606,461 | A | | 9/1971 | Moriyama |
| 4,614,338 | A | | 9/1986 | Castillo |
| 4,861,024 | A | | 8/1989 | Lee |
| 4,913,424 | A | | 4/1990 | Pepin |
| 5,184,363 | A | * | 2/1993 | Falbo, Sr. ..... 5/601 |
| 5,222,779 | A | | 6/1993 | Johnson |
| 5,275,176 | A | | 1/1994 | Chandler |
| 5,479,667 | A | * | 1/1996 | Nelson et al. ..... 5/636 |
| 5,649,886 | A | * | 7/1997 | Danylieko ..... 482/142 |
| 5,803,913 | A | | 9/1998 | Khalkhali et al. |
| 5,919,131 | A | | 7/1999 | Smoler et al. |
| 5,946,749 | A | | 9/1999 | Sewell |
| D423,240 | S | | 4/2000 | White |
| 6,185,768 | B1 | | 2/2001 | Schlechter |

(Continued)

FOREIGN PATENT DOCUMENTS

CH 684388 A5 9/1994

(Continued)

OTHER PUBLICATIONS

Examination Report of Korean Patent Office issued in corresponding Korean Application No. 10-2004-7021545, dated Mar. 30, 2010 (9 pages).

(Continued)

*Primary Examiner* — Glenn Richman

(74) *Attorney, Agent, or Firm* — Flynn, Thiel, Boutell & Tanis, P.C.

(57) ABSTRACT

The invention relates to a supporting device for the back and head of a human being. Said device comprises a partial area of a back supporting section at the level of the shoulder blade, a central supporting surface in the region of a vertebral column and open areas which are arranged on the both sides of the central supporting surface in such a way that the shoulder blade regions can be lowered beyond the central supporting area. The invention can be used for furniture for the household or workplace.

4 Claims, 9 Drawing Sheets

U.S. PATENT DOCUMENTS

| | | | | |
|---|---|---|---|---|
| 6,557,196 | B2 | 5/2003 | Falbo, Sr. et al. | |
| 7,037,247 | B1 | 5/2006 | Bergeron | |
| 2002/0056160 | A1 | 5/2002 | Falbo, Sr. et al. | |
| 2002/0132711 | A1* | 9/2002 | Wallerstein | 482/140 |
| 2003/0220176 | A1 | 11/2003 | O'Connor | |
| 2005/0239619 | A1* | 10/2005 | Carlucci et al. | 482/142 |
| 2005/0248204 | A1 | 11/2005 | Berg | |
| 2008/0248936 | A1* | 10/2008 | Ferriss et al. | 482/142 |
| 2009/0270236 | A1* | 10/2009 | Berc | 482/142 |

FOREIGN PATENT DOCUMENTS

| | | | |
|---|---|---|---|
| CN | 2407790 | Y | 11/2000 |
| JP | 50-3394 | A | 1/1975 |
| JP | 60-95055 | U | 6/1985 |
| JP | 1-61163 | | 4/1989 |
| JP | 3044059 | U | 9/1997 |
| JP | 2001-120387 | A | 5/2001 |
| JP | 2002-159520 | | 6/2002 |

OTHER PUBLICATIONS

International Search Report issued in corresponding International Application No. PCT/EP2003/006244, dated Sep. 4, 2003 (2 pages).

Translation of Japanese Patent Office Action issued in corresponding Japanese Patent Application No. 2004-518530, dated Jun. 3, 2008 (5 pages).

Chinese Patent Office Examination Report issued in corresponding Chinese Patent Application No. 03815779.9, dated Dec. 8, 2006 (4 pages).

* cited by examiner

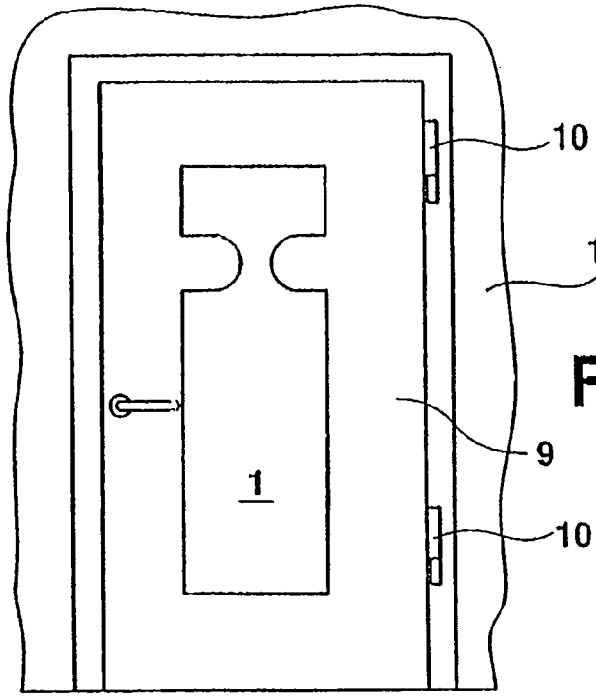
Fig. 7
Fig. 8
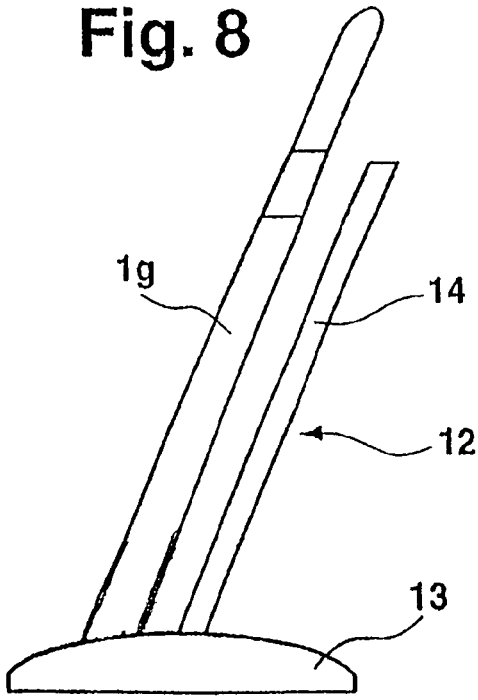
Fig. 9
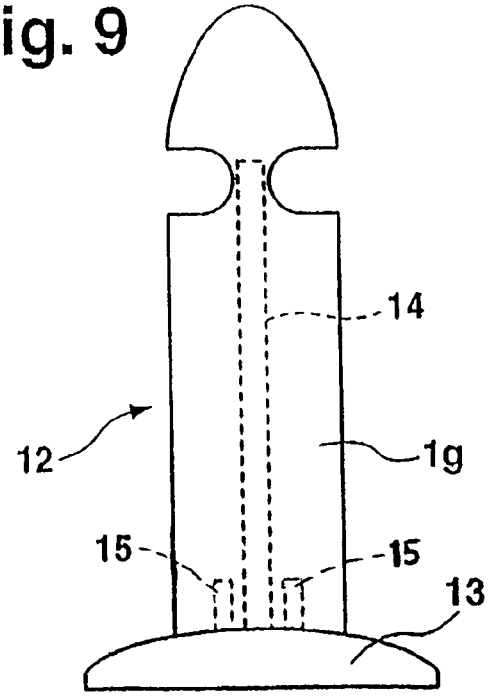

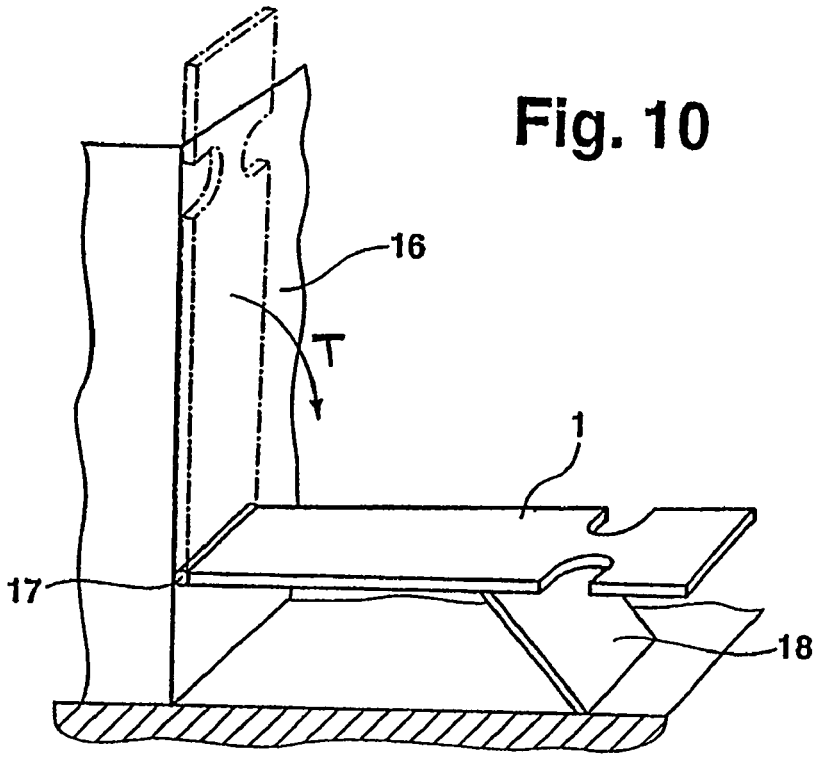
Fig. 10
Fig. 11
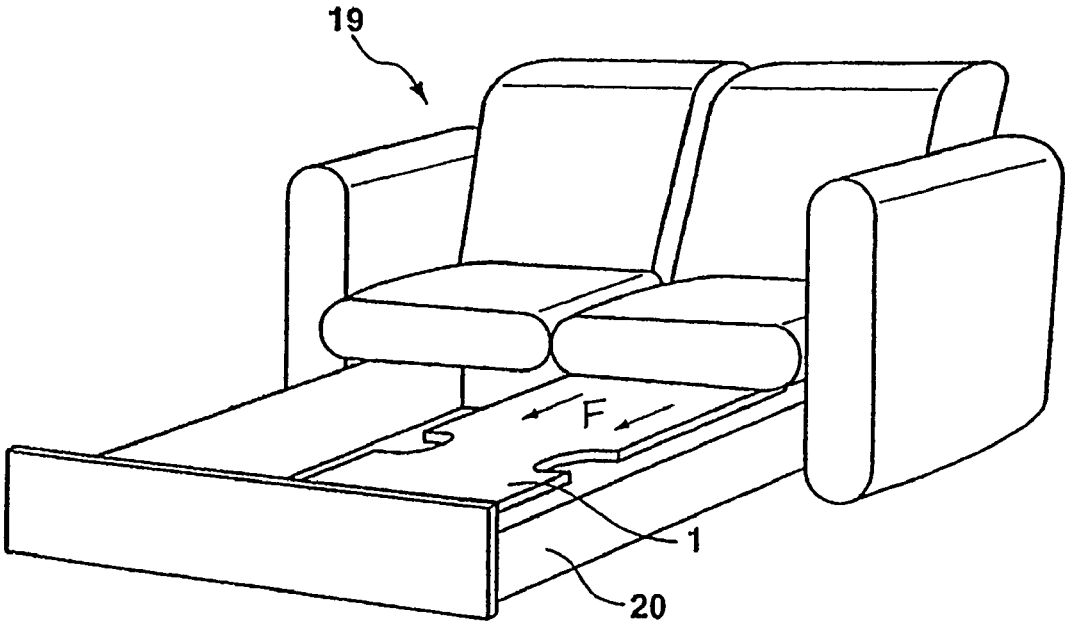

SUPPORTING DEVICE FOR A PERSON'S BACK AND HEAD AREA

CROSS REFERENCE TO RELATED APPLICATION

This application is a continuation-in-part of application Ser. No. 12/459,443, filed Jul. 1, 2009 now abandoned, which is a continuation of application Ser. No. 10/520,051, filed Dec. 29, 2004 now abandoned, which was the national stage of International Application No. PCT/EP2003/006244, filed Jun. 13, 2003, which International Application was not published in English, all of which prior applications are hereby incorporated by referenced herein.

FIELD OF THE INVENTION

The invention relates to a supporting device for a person's back and head area, with a back support section and with a head support section, and to a home or workplace furniture item or leisure item with such a supporting device.

BACKGROUND OF THE INVENTION

Such supporting devices are generally known in the form of couches or the like. Such supporting devices can be padded or unpadded. Individuals can take up position on supporting devices of this kind. If a person takes up a position lying on his back on such a supporting device, both the back area and the head area are supported. The back area extends from the coccyx to the neck area. To permit a secure support for the person, the supporting device has a back support section for the back area and a head support section for the head area. The back support section is designed with such a width as to permit a secure position of the person. In particular, the back support section has, at least from the hip area to the shoulder area, a width which corresponds at least to the width of the corresponding areas of the person, so as to allow the person to lie securely on it. Such supporting devices often have an orthopedic design and/or adapt naturally to the person's posture.

A person's posture is often poor in orthopedic terms. In particular, poor posture at the workplace or in other environments may lead to shortening of the chest muscles, which in turn can lead to a rounded back posture, in particular to a hunched back. In this regard, a rounded or hunched back is believed, on a psychological level, to evoke negative feelings, whereas an erect posture evokes positive feelings.

Additionally, the various sources of stress in modern lifestyles cause many people to become out-of-balance on a daily basis. When there is too much stress in one's life, it is difficult to be in a good mood, and focus, concentration creativity, breathing, communication skills, performance, digestion and posture are often compromised by stressful situations. Speaking long-term, too much stress, which is known to evoke the "flight or fight" reaction, tends to build up and cause blockades, pain, illness, disease, disorders and even changes in the cellular structure of the body. People who do not feel well typically do not perform well, and it is estimated that approximately 70% to 80% of doctor visits are stress-related. Further, the innate cycle of the human body is designed to have several passive breaks in the course of a day. Such breaks are believed necessary to make us feel better, digest our food efficiently, re-energize and revitalize us, and to keep our conscious and subconscious minds in balance. In recent times, such breaks have been disregarded in favor of the desire to stay constantly active and productive, without an understanding or appreciation of the consequences which can result from continued stress on the body and mind.

The object of the invention is to make available a supporting device of the type mentioned at the outset which, by simple means, in particular by allowing a stretching exercise, makes it possible to counteract shortening of the chest muscles. Additionally, such a supporting device and the use thereof during breaks taken during the course of the day make it possible to counteract the effects of daily stress on our bodies and minds through such a stretching exercise and relaxation.

SUMMARY OF THE INVENTION

This object is achieved by the fact that, in a supporting position, a partial area of the back support section has, at the level of shoulder blade areas of the back area, a support surface in a spinal column area and, on both sides of the support surface, has open areas which are configured in such a way that the shoulder blade areas can move downward past the support surface.

According to the invention, therefore, a person lying on his back on the supporting device can stretch his chest muscles in a simple manner by extending his arms out to the sides while turning the palms of the hands upward and either leaves them, in the outwardly extended position, under their inherent weight or actively moves the arms and thus also the shoulders downward, i.e. toward the rear side of the back support section. Since, at shoulder blade level, the support surface provides only a central, preferably narrow and at least partial support in the spinal column area and since the shoulder blade areas can be moved at least substantially freely downward, i.e. past the support surface toward the rear side, it is possible to stretch the chest muscles. The person preferably lies on the supporting device in a position which is in an angle range of 45° to 90° to the vertical. In the supporting position, an at least approximately horizontal alignment of back section and head support section is particularly preferred. In this way, the inherent weight of the arm and shoulder areas already effects a desired stretching of the chest muscles, without the person necessarily having to actively exert force in order to achieve the aim of stretching the chest muscles. The supporting device thus fulfills a double function in that the provision of the recumbent position ensures a relaxed posture and, in addition, the simple lateral extension and subsequent lowering at least of the upper arms approximately at right angles to the thoracic cage ensures stretching of the chest muscles. If the forearms too, in straight continuation of the upper arms, are extended laterally outward approximately at right angles to the thoracic cage area, the lever effect caused by the inherent weight of the arms is further increased, so that the stretching effect of the chest muscles is also improved. The open areas present on both sides of the central support surface can each be completely open to the outside within the entire support surface formed by the back support section and the head support section. Alternatively, they can also be closed in the lateral outer edge areas if the transverse extent of the open areas is so great that, with the upper arms extended at right angles, at least the elbow areas can move downward through the open areas. However, the open areas are preferably also designed to open laterally outward in order to permit the desired mobility of the shoulders and arms even when the total width of the supporting surface is small. From the coccyx or hip area to just below the shoulder blade areas, the back support section is advantageously made at least so wide that it corresponds to the width of a human thoracic cage, so as to permit secure supporting of the person's back area at least to just under the shoulder areas. The head support section too is preferably configured so that it ensures a secure supporting of the head.

The solution according to the invention can be applied in different environments. In particular, it can form part of various items of furniture in the home, office or workplace or in the leisure sector. The supporting device can in particular rest on a separate base, for example a frame, or can itself be provided with suitable support, frame or leg elements in order to permit positioning on a base. In a particularly simple embodiment, the supporting device is formed as a rigid support unit by means of a single panel made of shape-stable material, in particular wood or plastic, which is provided with the back support section, including the support surface and the lateral open areas, and with the head support section. In other functional arrangements, such a panel can be integrated within them or coupled to them. Thus, in particular, it is possible to arrange such a panel removably in the area of a room door or in the area of a room wall and, when so required, to remove it from the door or wall and position it on a suitable base. Alternatively, an embodiment is proposed in which such a panel is arranged releasably on an item of home or office furniture. In particular, it is proposed to fit such a panel standing in a pedestal forming part of a light, and in particular provided with at least one luminescent tube situated behind the panel. The panel serving as supporting device thus has an additional function, by serving as a shade or screen for the lighting means.

In one embodiment of the invention, the head support section and the back support section are separate structural parts which can be fitted to one another for the supporting position, forming the open areas. In this way, it is possible to fit the head support section and the back support section to each other to form the desired supporting position for back and head only when required. When not needed for stretching of the chest muscles, the head support section and the back support section can have entirely different functions. Thus, it is possible in particular to use the surface of at least one support section as a table top or as a seating arrangement when the supporting function for a person's body is not required.

In one embodiment of the invention, the open areas are formed by laterally open recesses of the back support section. In this case, the back support section in an area below the recesses, seen toward the foot of the body, is advantageously much wider than the central, preferably narrow support surface at the level of the shoulder blade areas, so that a secure support is obtained in the rear rib area of the person's body. The recesses advantageously form a division of the back support section from the head support section, so that the connection by means of the support surface is maintained only between the head support section and the back support section at least for the supporting position.

In a further embodiment of the invention, the recesses can be closed by detachable or movable cover elements. As soon as the recesses are closed by suitable cover elements, the back support section preferably including the head support section can have a continuous panel shape or continuous surface. In this way, the back support section and/or head support section can be used for completely different functions when they are not fitted together for the supporting position.

In a further embodiment of the invention, the back support section and the head support section are integrated in a rigid support unit. The back support section and the head support section are thus part of a common rigid unit. The back support section and the head support section advantageously form a shape-stable panel which, when not needed for chest stretching purposes, can be used in another way, in particular as a table, as a seating arrangement or similar.

In a further embodiment of the invention, the rigid support unit is arranged so as to be movable between an in particular vertical rest position and an in particular horizontal supporting position. In this way, it is possible for the back support unit formed by back support section and head support section to be moved to the desired supporting position only when so required. When not required, the support unit can have another function or can remain without any function in a rest position. In particularly preferred embodiments, the support unit is positioned movably in the area of table arrangements or is alternatively designed as a fold-out backrest of a chair or stool. It is advantageously also possible to integrate the support unit in a concealed manner in a seat or couch and bring it to the supporting position only when needed. Pivot bearings, linear guides and similar are in particular provided for the movable arrangement of the support unit between the rest position and the supporting position.

In a further embodiment of the invention, the head support section and the back support section are mounted with respect to one another so as to be movable between the rest position and the functional position by guide means. The guide means provided can be combined swivel/slide guides, purely linear guides or hinge arrangements, or otherwise configured cam guides.

The supporting device according to the invention can be used particularly advantageously for home furniture items, leisure items or workplace items. It is used particularly advantageously in seats, couches or combined seat/couch units. Such items of furniture can be both stationary and also movable, i.e. can be accommodated in particular in vehicles or even in buildings or rooms.

The invention also relates to an add-on unit which, together with existing items of furniture or other objects which each have a surface part, form a supporting device in the sense of the invention. The add-on unit according to the invention has a head support section and a spacer part serving as a support surface for the spinal column area. The add-on unit is secured by means of at least one connection element to a surface part of the item of furniture or of the object, and the surface part, when the head support section and spacer part are added on, takes over the function of the back support section of the supporting device. The spacer part is designed in such a way that the open areas are obtained on both sides for movement of the shoulder blades. The spacer part is also designed so narrow, as support surface for the spinal column area, that suitable shoulder blade movements are not impeded by the spacer part. By means of this solution, it is possible in particular to attach the add-on unit to existing table, seat and/or couch units and so obtain a supporting device according to the invention.

The supporting device according to the invention is a tool that invites one to take a short break or several of these short breaks, during the course of a day to help one feel more balanced and able to handle daily stress. Too much stress creates a build-up of toxic daily stress loads in the human body, much like the way cavities and plague affect our oral hygiene. In the way that the use of a toothbrush and toothpaste improve oral hygiene, daily breaks which incorporate the use of the supporting device according to the invention improve the state of the body and mind. The stretching of the chest muscles utilizing the supporting device as described above allows the user to take a break by lying safely supported on the device while the shoulder blade areas are placed into the respective open areas located on opposite sides of the central support surface of the device, so that the user can, virtually effortlessly, with the arms positioned wide open and sidewardly, achieve a very wide stretch of the chest area by simply allowing the arms to lower due to the effect of gravity. To achieve this, it is imperative that the open areas are of a size large enough to accommodate the movement of the shoulder blade areas as the arms are lowered, with only the portion of the spine located between the shoulder blade areas being fully supported as well as the head and remainder of the back below the shoulder blade areas.

Utilizing the supporting device according to the invention during daily breaks which include the combination of resting, the wide-open arm posture and the wide-open stretching of the arms and movement thereof downwardly, is believed to achieve greater results than a typical rest period, such as when one takes a coffee break, for example. Specifically, daily breaks performed on the supporting device according to the invention balances stress levels, promotes relaxation, healing, restructuring, recovery and re-energization in a relatively short time.

Further, such breaks utilizing the supporting device of the invention help to balance and/or improve the body's reaction to stress as follows: by correcting posture of the back and/or neck which will positively influence mood and open the mind; the wide open positioning of the arms during the stretching exercise is a positive signal which evokes positive changes in the conscious and unconscious mind; the wide open positioning of the arms triggers a quick switch in the autonomic nervous system (ANS) from the sympathetic division of the ANS which functions when quick responses are required (i.e. the "fight or flight" reaction), to the parasympathetic division of the ANS which functions when immediate reaction is not required (i.e. resting and digesting); the wide open positioning of the arms physically shifts and affects the tension in the body, since the stretching of the chest area results in a less pinched stomach area which fosters deeper abdominal breathing to bring more oxygen to the bloodstream; the wide opening positioning of the arms provides better conditions for the body, mind and nervous system to operate; the wide open positioning of the arms and the stretching of the chest muscles which is performed while resting creates a relaxed and positive environment for thinking and/or meditating, and allows the user to achieve a creative and positive mindset; and during inner or outer conflicts, taking a break which utilizes the supporting device of the invention buys time, and in combination with the wide opening positioning of the arms and positive posture, such a break balances fears, anxieties and aggressions and creates a positive, harmony-driven, and improved emotional and social state, which can provide a more effective resolution of the conflict.

A break which utilizes the supporting device of the invention is recommended for approximately 2-5 minutes, for example. Once the user allows the lowering of the arms under the force of gravity, the break involves full relaxation, since the user is physically not active but is instead only resting in a fully-supported state on the supporting device. Such a break differs from and is believed to outperform other stress-relief activities such as walking, yoga, or other sports which involve physical activity such that the body is not allowed to physically rest. Further, these other methods of stress-relief require more time to provide a calming effect, while the instant invention virtually effortlessly provides this effect in a shorter time. This recommended duration of a break is based on the typical acceptable amount of time required to go to the coffee machine or to use the restroom, for example.

The supporting device according to the invention is an easy-to-use device for anyone who is exposed to and affected by stress from the environment and/or from past or present problems and conflicts. Taking a break utilizing the supporting device invites one to escape into a short-term retreat, to regenerate and to find better mental and physical balance by managing stress, which will result in improved performance and possibly a longer life. A relaxed person is not as easily affected or knocked out-of-balance by a stressful situation, and a balanced person feels better and communicates better both inwardly and outwardly, is more creative, and concentrates and performs better. The more a person manages to integrate stress-free intervals into his or her daily life, the more healthy and balanced his or her life will be.

The supporting device of the invention and daily breaks utilizing same are an ideal tool for offices, homes, schools, universities, work environments, lounges, lobbies, and retreats, to name only a few. The supporting device and method of its use are convenient and can be utilized wherever people have a few minutes to spare, and can even be used in waiting rooms, shops, restaurants, banks, parks, etc. Additionally, taking a break according to the invention when one comes home from work will help to relieve one from the stress of work, and/or prior to going to bed to help to facilitate sleep since one will already be in a calm state before lying down in bed. The supporting device and use thereof is a relaxation method which can be used to re-establish breaks into our daily life. Breaks are often not taken by employees presently, as doing so might invite sanctions by employers or give the impression that one is lazy or being unproductive. When one takes a break on the supporting device disclosed herein, this can signal to others that the person is relaxing so as to achieve greater balance and efficiency, and not to disturb the person since when the person is finished, he or she will be relaxed and more focused. This new relaxing-inducing behavior will allow society to reevaluate the quality and necessity of breaks and to rethink the exhausting lifestyle prevalent in society today. The integration of short and efficient breaks as described herein is much easier and more convenient than finding time for other relaxation techniques such as yoga, walking or meditation, for example.

When using the supporting device according to the invention, the body is given a chance to rest and to become calm, gravity is utilized to achieve the lowered wide-open arm posture due to the wide open areas in the shoulder blade areas of the supporting device to achieve the widest-possible stretch of the chest area, and the supine position of the body along with the wide-open and lowered arm posture work together to boost and trigger calming energies which serves to switch one from the fight or flight mode to a resting and digesting mode.

BRIEF DESCRIPTION OF THE DRAWINGS

Further advantages and features of the invention are set out in the claims and in the description, given below, of preferred illustrative embodiments of the invention explained with reference to the drawings in which:

FIG. 7 shows a support unit according to FIG. 1, which is integrated removably in a corresponding recess of a room door, FIG. 8 shows a lighting object in side view, in which a screen is additionally designed as supporting device similar to FIG. 2, FIG. 9 shows the lighting object according to FIG. 8 in a front view, FIG. 10 shows a further embodiment of a supporting device according to the invention in a perspective view, in which the panel-like support unit in a rest position lies on a wall and, for the supporting position shown in FIG. 10, is folded out into a horizontal setting, FIG. 11 shows a seat and/or couch in which the supporting device is integrated in a pull-out casing.

DETAILED DESCRIPTION OF THE INVENTION

Figure 1:
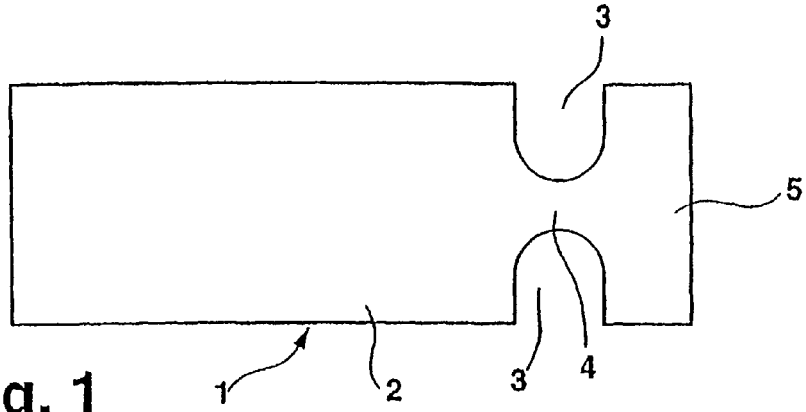
FIG. 1 shows a schematic plan view of an embodiment of a supporting device according to the invention in the form of a panel-like support unit.
Figure 2:
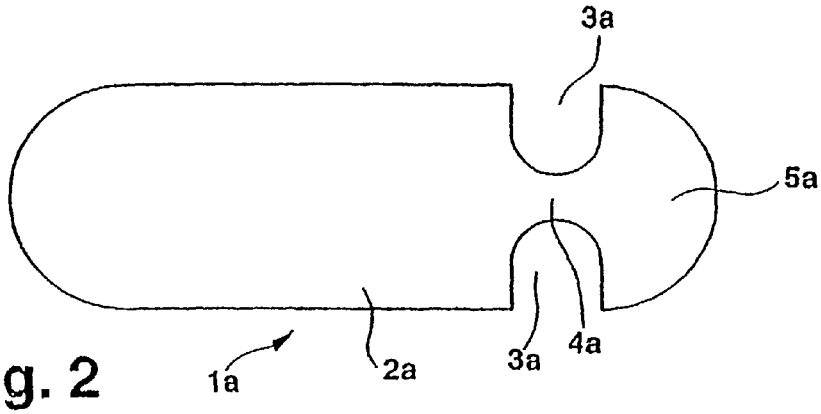
FIG. 2 shows a supporting device similar to FIG. 1.
Figures 3A, 3B, 3C, 3D, 3E:
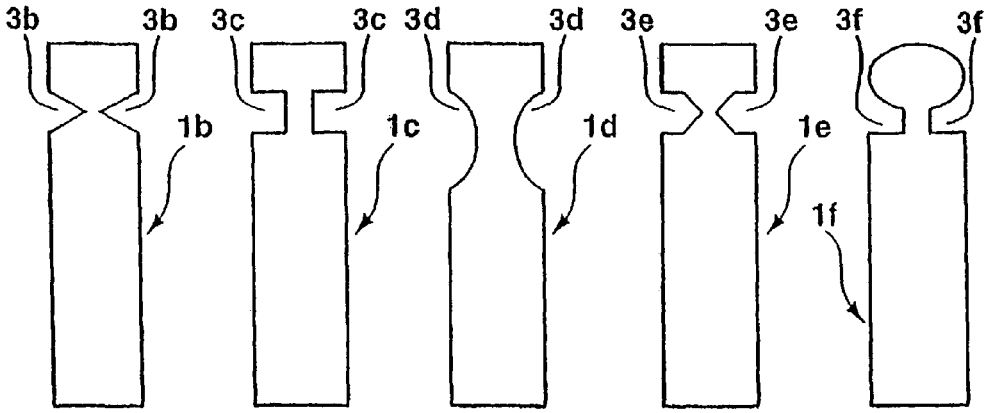
FIG. 3*a* shows a further alternative embodiment of a supporting device similar to FIGS. 1 and 2.
FIG. 3*b* shows a further alternative embodiment of a supporting device similar to FIGS. 1 and 2.
FIG. 3*c* shows a further alternative embodiment of a supporting device similar to FIGS. 1 and 2.
FIG. 3*d* shows a further alternative embodiment of a supporting device similar to FIGS. 1 and 2.
FIG. 3*e* shows a further alternative embodiment of a supporting device similar to FIGS. 1 and 2.

Supporting devices according to FIGS. 1 to 27 are used, in their supporting position, as benches or supports for the body of a person lying on his back. In the position lying with his back and head on the supporting device, the person in question, by extending his arms out to the sides, can move the arms and shoulders downward. To do so, he has to position himself on the supporting device in such a way that corresponding movements of the shoulder areas, in particular of the shoulder blade areas, do not meet any resistance from the supporting device. This is described in more detail below. The supporting devices according to FIGS. 1 to 3 are constructed with the same function, so that the basic functional parts will be described first with reference to FIG. 1, and parts or sections having the same function are provided with the same reference numeral in the following figures, but with addition of a differentiating letter (i.e., a, b, c, d, e, f). The supporting device is formed by a panel-shaped support unit 1, 1*a*, 1*b*, 1*c*, 1*d*, 1*e*, 1*f*. The support unit has a back support section 2, 2*a* (not numbered in FIGS. 3*a*-3*e*), a central support bridge 4, 4*a* serving as support surface, and a head support section 5, 5*a* adjoining the support bridge 4, 4*a*. Provided on both sides, at the level of the support bridge 4, 4*a*, there are recesses 3, 3*a*, 3*b*, 3*c*, 3*d*, 3*e*, 3*f* which are open toward the outside. The support bridge 4, 4*a* extends along a midline axis (not shown) of the supporting device which in the present case has an overall rectangular shape. A person lying on the support unit has to position himself in such a way that he is lying with his shoulder blade areas at the level of the recesses 3, 3*a*, 3*b*, 3*c*, 3*d*, 3*e*, 3*f* and his head is supported from behind. The support bridge 4, 4*a* serving as support surface is preferably made so narrow that, when the arms and shoulders are extended and lowered, it does not impede the free movement of the shoulder blades at least over a limited arm or shoulder path. The limited arm and shoulder path is defined in that a sufficient extension of the chest muscles has to be possible. The proportions of the corresponding sections of the support unit are preferably adapted to the body of a normal person.

The person lying on the supporting device preferably performs a stretching exercise such that, lying on his back, he extends his arms horizontally out to the sides and in doing so turns the palms of the hands upward. Through the inherent weight of the extended arms, these necessarily move, together with the shoulder areas and shoulder blade areas, downward in the area of the recesses 3, 3*a*, 3*b*, 3*c*, 3*d*, 3*e*, 3*f* toward a base, as a result of which the transversely running chest muscles lying to the front are stretched. In this way, it is possible to effectively counteract shortening of the chest muscles in a relaxed position and without great effort, by which means injury due to poor posture can be avoided or reduced.

In the embodiment according to FIG. 2, the lower and upper end areas of the support unit, as seen in the direction of the body, are rounded as arcs of circles. The function of the support unit does not differ in any way from that explained regarding FIG. 1. FIGS. 3*a* to 3*e* show further different forms of support units (1*b*, 1*c*, 1*d*, 1*e*, 1*f*, respectively) whose functions each correspond to the functions described with reference to FIG. 1. The depictions are in each case schematic, so that the proportions do not necessarily correspond to the proportions that actually arise in practice. This applies also to all the supporting devices described in detail farther below.

In the embodiments according to FIGS. 3*a* to 3*e*, the lateral recesses 3*b*, 3*c*, 3*d*, 3*e*, 3*f* in particular are provided with different geometric shapes which can be seen clearly from the drawings and therefore do not have to be explained in detail at this point.

Figure 4:
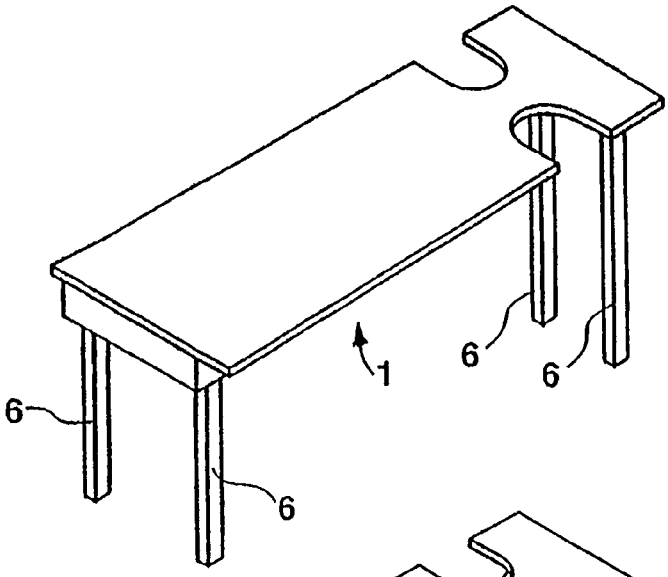
FIG. 4 shows a supporting device provided with rigid, straight support legs.
Figure 5:
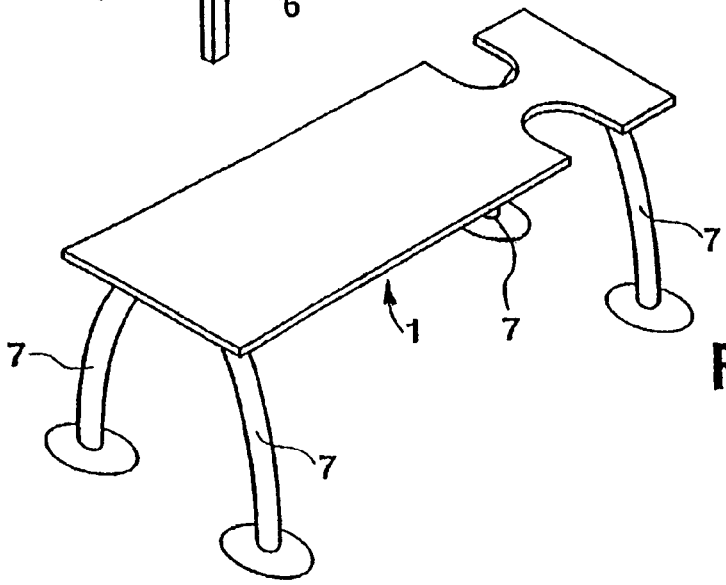
FIG. 5 shows a supporting device similar to FIG. 4, but with curved table legs.

In the embodiment according to FIG. 4, the support unit according to FIG. 1 is provided with support legs 6 standing on a base. These are designed as rectilinear square profiles in the embodiment according to FIG. 4. In the embodiment according to FIG. 5, rigid support legs 7 of curved form with broad floor rests are provided. The support unit 1 according to FIG. 5 corresponds to the support unit according to FIG. 4.

Figure 6:
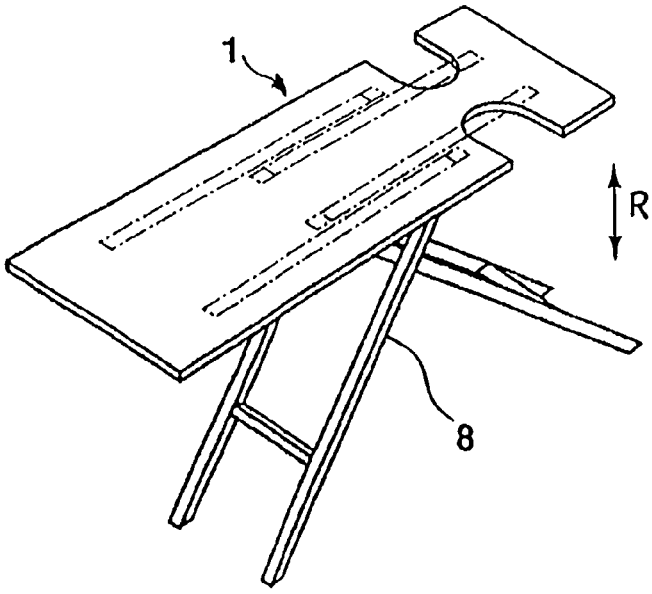
FIG. 6 shows a supporting device with a panel-like support unit composed of head support section, recesses and back support section, and provided with a frame that can be folded up in the manner of an ironing board.

In the embodiment according to FIG. 6, the panel-shaped support unit 1 is held by a fold-up frame 8 designed in the manner of an ironing board frame that folds up under support unit 1 as shown by the double-headed arrow R. The folded-up position of the frame 8 is shown by broken lines. In this way, the support unit 1 does not take up space when not in use.

In the embodiment according to FIG. 7, the support unit 1, so as to be accommodated without taking up space when not in use, is mounted in a corresponding recess of a larger surface, in the present instance in a room door 9 which is held with the aid of hinges 10 on a room wall 11. As soon as the support unit 1 is needed, it can be removed from the corresponding recess of the room door 9 and brought into the supporting position at a suitable place.

To bring it to the supporting position, the support unit 1 can in particular be placed on one or more support or frame elements. To fix the support unit 1 in the recess of the room door 9, detachable securing means are provided in the area of the room door 9.

In the embodiment according to FIGS. 8 and 9, a support unit 1*g* formed in the shape of a surfboard is additionally used as object part of a lighting object 12 by being positioned parallel in front of a standing fluorescent tube arrangement 14. For this purpose, the support unit 1*g* is provided in its base area with plug connection elements 15 which can be plugged releasably onto corresponding plug connection elements of a pedestal 13. The fluorescent tube arrangement 14 is also anchored firmly in the pedestal 13 in its oblique position. Embodiments not shown here include other types of household or design objects in which a correspondingly adapted support unit is integrated in each case.

In the embodiment according to FIG. 10, a support unit 1 is mounted at its lower end area, by means of a hinge arrangement 17 defining a horizontal pivot axis, on a vertical wall 16 such that it can be moved as indicated by the directional arrow T between a folded-away rest position, indicated by broken lines, and a supporting position, indicated by solid lines. For the supporting position, a support foot arrangement 18 is provided which can be articulated on the underside of the support unit 1 or can be added as a separate part to the underside of the support unit 1.

In the embodiment according to FIG. 11, the support unit 1 is integrated in a pull-out casing 20 of a seat unit and/or couch unit 19, in the present instance in the form of a sofa bed. The pull-out casing 20 is pulled from a stored position, in the direction indicated by directional arrows F, to the illustrated use position. The support unit 1 is mounted stably on corresponding frame parts of the pull-out casing 20 so that, in the pulled out position of the pull-out casing 20 shown in FIG. 11, the support unit 1 is converted directly to its supporting position. A person can thus lie down with his back on the support unit 1 and preferably rest his leg areas on the seat cushion and back cushion of the sofa bed. In embodiments not shown, the support unit is accommodated in a pull-out element in the form of a drawer or the like, the pull-out element being able to be integrated in any desired, suitable mobile or immobile object such as, in particular, an air, sea or land vehicle, in a housing of a machine or a plant, or in other arrangements.

Figure 12:
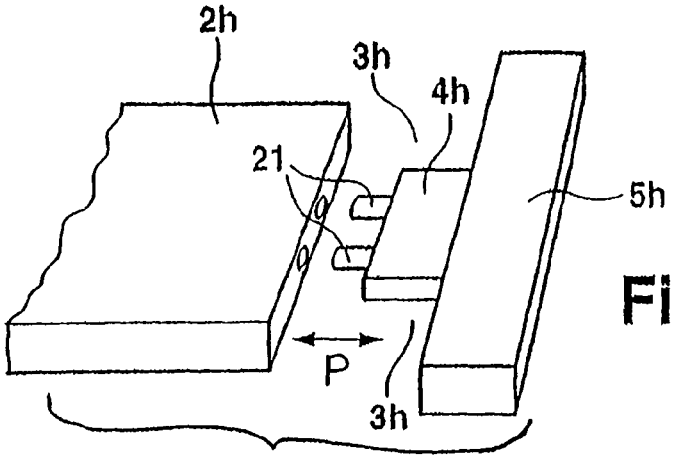
FIG. 12 shows a perspective view of part of a supporting device in which a head support section can be plugged onto a back support section and form the open areas.

In the embodiment according to FIG. 12, the head support section 5*h*, including the central support surface 4*h* serving as spacer part and located at the level of the recesses 3*h*, is designed so as to be detachable from the back support section 2*h*. An add-on unit is thus formed. For this purpose, connection elements in the form of plug connections 21 are used which, in the direction of the double-headed arrow P, allow the head support section 5*h* to be removed from or pushed in the area of the corresponding end face of the back support section 2*h* serving as surface part.

The support surface 4*h* is configured in a panel shape so that, in the plugged-in state, the head support section 5*h* remains positioned at a distance from the two back support sections 5*h*. In this way, the recesses 3*h* are formed.

Figure 13:
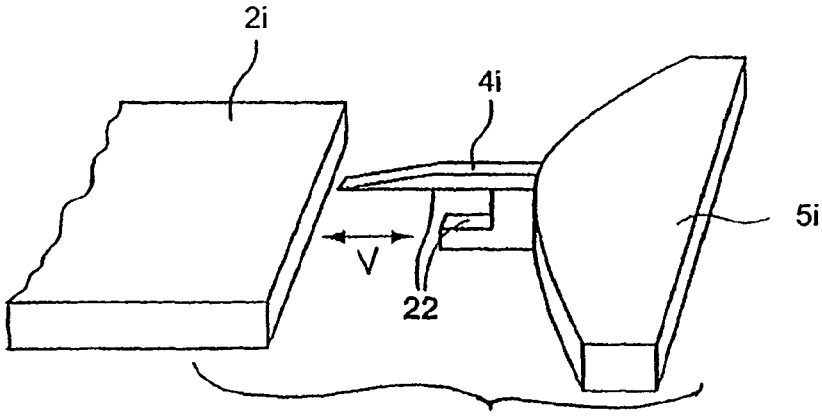
FIG. 13 shows a further embodiment similar to FIG. 12 in which, once again, a head support section can be plugged onto a back support section and form the open areas.

A similar design with an add-on unit is shown in FIG. 13. There, only the nature of the plug connection 22 is different. Corresponding arms of the plug connection 22 engage across the top and bottom of the panel shape of the back support section 2*i* in the manner of a bracket, as the head support section 5*i* is attached to or removed from the back support section 2*i* in the illustrated direction of the double-headed arrow V. The upper arm of the plug connection 22 additionally forms the central support bridge 4*i* for supporting the spinal column of the person's body at the level of the shoulder blade areas between the back support section 2*i* and the head support section 5*i*.

Figure 14:
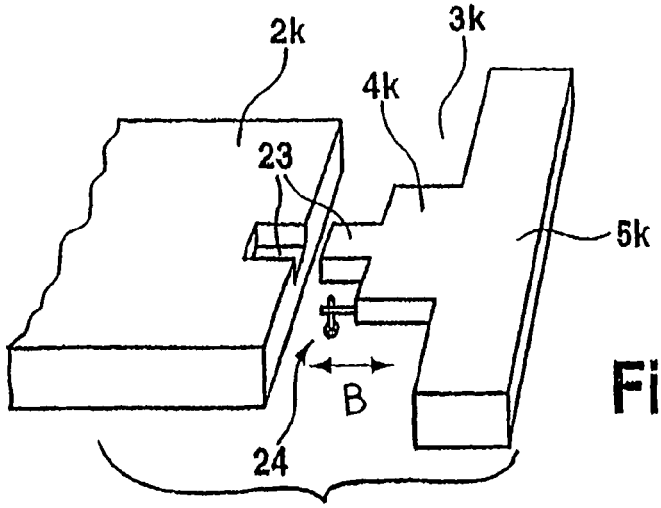
FIG. 14 shows a further embodiment similar to FIG. 13 with fixing means for the supporting position, in this instance in the form of a screw clamp.

The embodiment according to FIG. 14 with an add-on unit is also similar to the embodiments according to FIGS. 12 and 13, attachable or detachable in the direction of the double-headed arrow B. The main difference here is that, for attaching the head section 5*k* including the support surface 4*k* to the back support section 2*k*, with corresponding recesses 3*k*, the plug connection 23 is additionally assigned securing means 24 in the form of a screw clamp which permits fixing of the assembled state.

Figure 15:
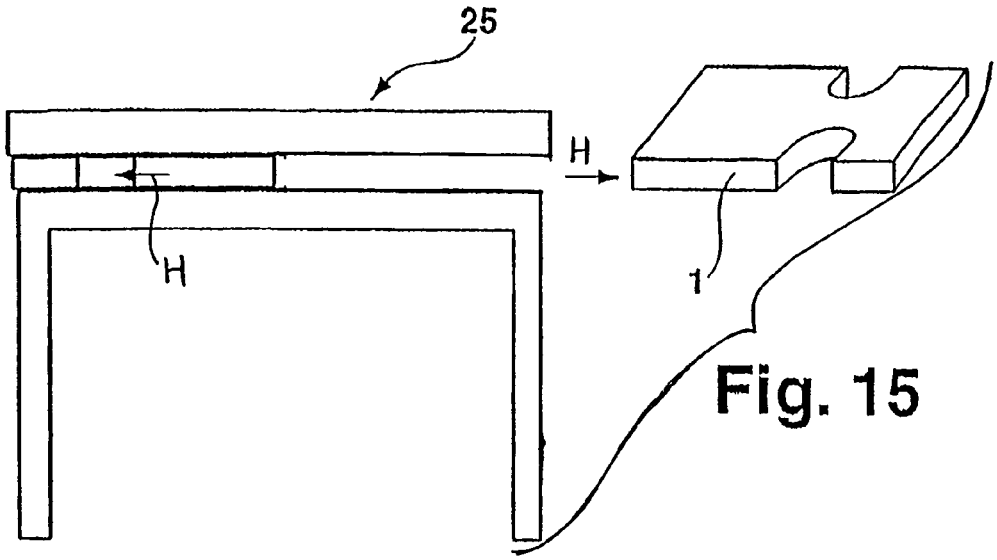
FIG. 15 shows a further embodiment of a supporting device integrated in a table.

In the embodiment according to FIG. 15, an item of furniture in the form of a table arrangement 25 is provided. Under a table top of the table arrangement 25, a hollow space is provided in which two support units 1 are accommodated. In the embodiment according to FIG. 15, the table arrangement thus serves only as storage space for the support units 1. In an illustrative embodiment not explicit from FIG. 15, the two support units 1 are positioned in the manner of pull-out panels linearly displaceably under the upper table top and for converting them to their supporting position can be drawn out from the corresponding storage space as indicated by the directional arrows H and preferably brought to the same level as the table top. With the aid of support means (not shown), at least one of the support units 1 is then fixed in this supporting position. The table top thus serves as a support for the leg and buttock areas of a person whose back area and head area is positioned in the area of the support unit 1.

Figure 16:
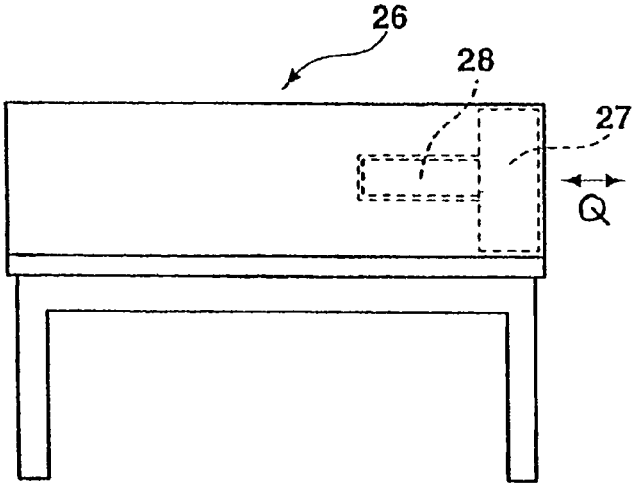
FIG. 16 shows a further table arrangement which can take over the additional function of a supporting device.
Figure 17:
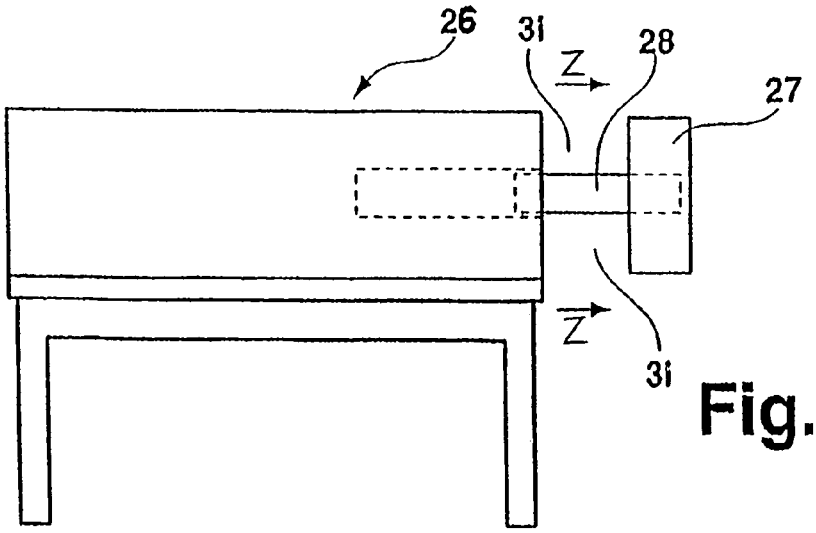
FIG. 17 shows the table arrangement according to FIG. 16 in its supporting position.

FIGS. 16 and 17 show a further table arrangement 26 which, like the last-described embodiment, is provided with a pull-out head support section 27. In its rest position, the head support section 27 is arranged under a table top of the table arrangement 25 according to FIG. 16, and is extendable or retractable as illustrated by the double-headed arrow Q. To obtain the lateral recesses 3*i* at shoulder blade level, the head support section 27 is moved in a simple manner to the position according to FIG. 17, as shown by the directional arrows Z, a guide bridge section 28 remaining firmly connected to the head support section 27. The guide bridge section 28 is responsible for the linear guiding and is mounted in corresponding rails underneath the table top. The guide bridge also has the function of central support surface for supporting the spinal column in the shoulder blade area, its corresponding dimensions being adapted to this function.

Figure 18:
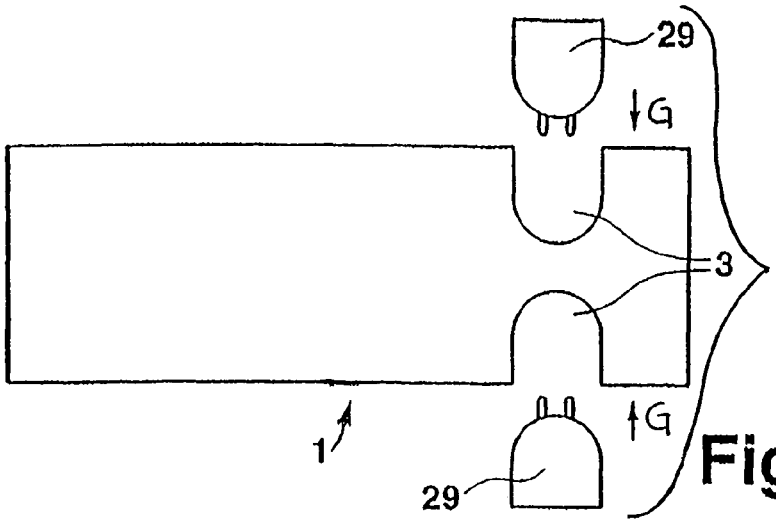
FIGS. 18 to 20 show various representations of detachable or movable cover elements which, in the rest position, close the recesses and, for the supporting position, free these recesses.
Figure 19:
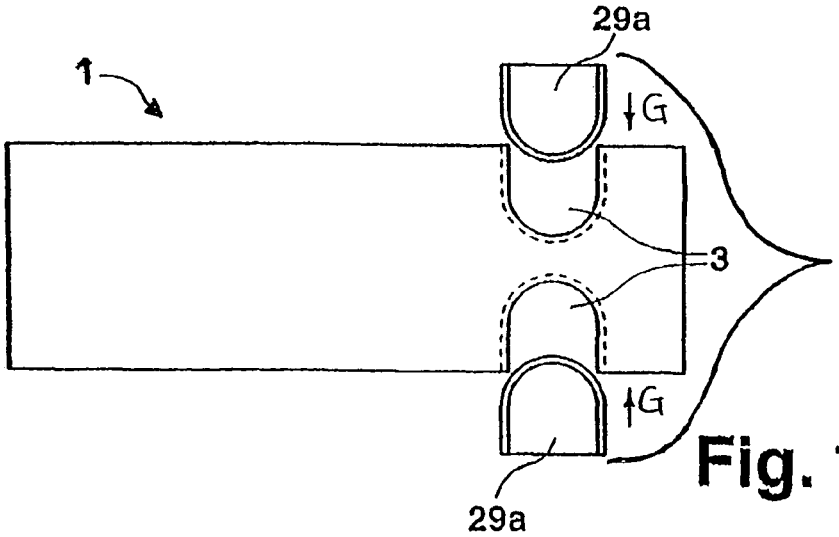
Figure 20:
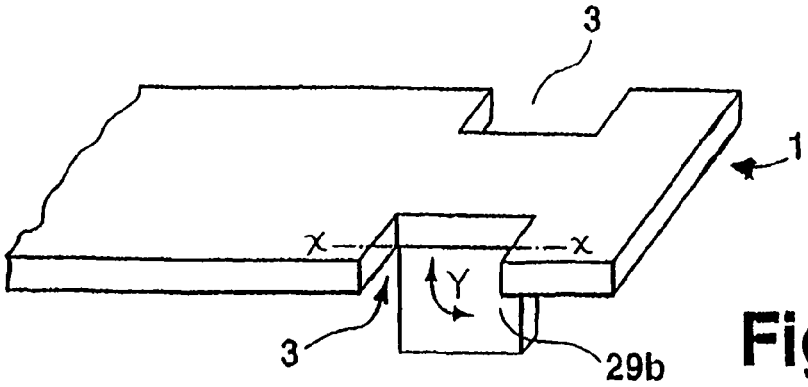

In the embodiments according to FIGS. 18 to 20, the recesses 3 of the support unit 1 can be closed off by cover elements 29, 29*a*, 29*b* inserted into the recesses 3 in the manner illustrated by the directional arrows G in order to obtain a continuous panel form or continuous surface even in the area of the recesses 3. In this way, the panel-like support unit can fulfill additional functions, in particular by being able to function as a table top.

In the embodiment according to FIG. 18, the cover elements 29 are inserted into the support unit in a simple manner with the aid of plug-in pins.

In the embodiment according to FIG. 19, the plug elements 29*a* have cover edges which interact with corresponding plug grooves on the support unit 1 in the area of the recesses and thus permit horizontal plugging in or pulling out.

In the illustrative embodiment according to FIG. 20, the cover elements 29*b* remain connected to the support unit 1. The cover elements 29*b* are connected to the support unit 1 via a hinge arrangement (not shown in detail) about horizontal pivot axes x-x in the area of the bottom of each recess 3, allowing rotation of the cover elements 29*b* as illustrated by the double-headed arrow Y. By means of securing elements (not shown in detail), the cover elements 29*b* can be fixed in the rest position closing the recesses 3.

Figure 21:
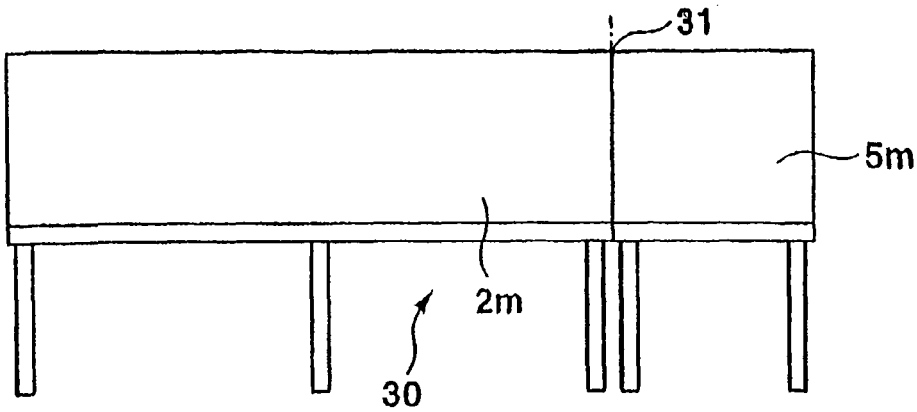
FIGS. 21 and 22 show a further furniture arrangement serving additionally as a supporting device, the supporting position being shown in FIG. 22.
Figure 22:
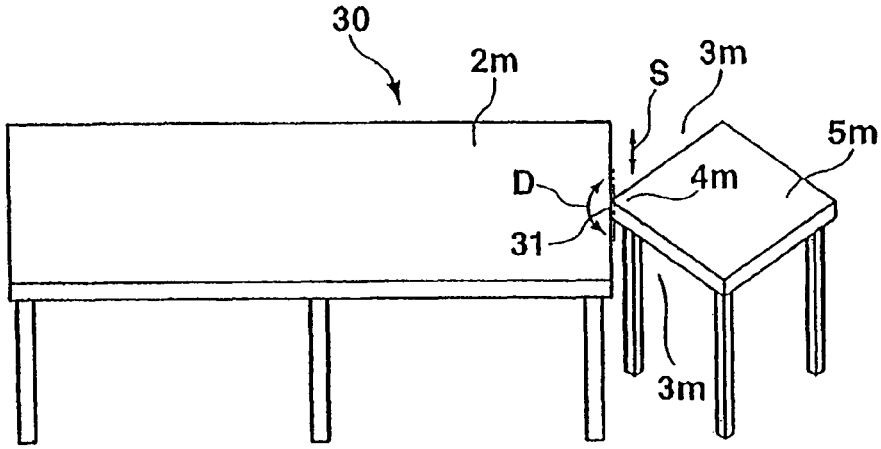

In the embodiment according to FIGS. 21 and 22, a table arrangement 30 is provided which is made up of an elongate table with rectangular table top and of a square table of the same width as the elongate table. The square table is connected permanently via a swivel/slide guide 31 to an adjacent end face of the table top of the elongate table. A slide element is preferably provided at a corresponding corner of the square table and is guided in a slide guide extending along the table top of the elongate table and additionally permits a swivel movement of the square table.

With this configuration, it is possible to use the table arrangement 30 also as a supporting device. The corresponding supporting position is shown in FIG. 22. The square table with its table top serves on the one hand as head support section 5*m* and, on the other hand, in the position turned through 45°, its corner area comprising the slide element acts as a support surface 4*m* for the spinal column of the person in the shoulder blade area. By turning it through 45°, the desired recesses 3*m* for the shoulder blade areas are additionally created on both sides of the corner carrying the slide element. The table top of the elongate table, in its area adjacent to the square table, has a back support section 2*m*. The slide movement of the square table is indicated by the double arrow S and the combined pivotability is indicated by the double arrow D in FIG. 22.

Figure 23:
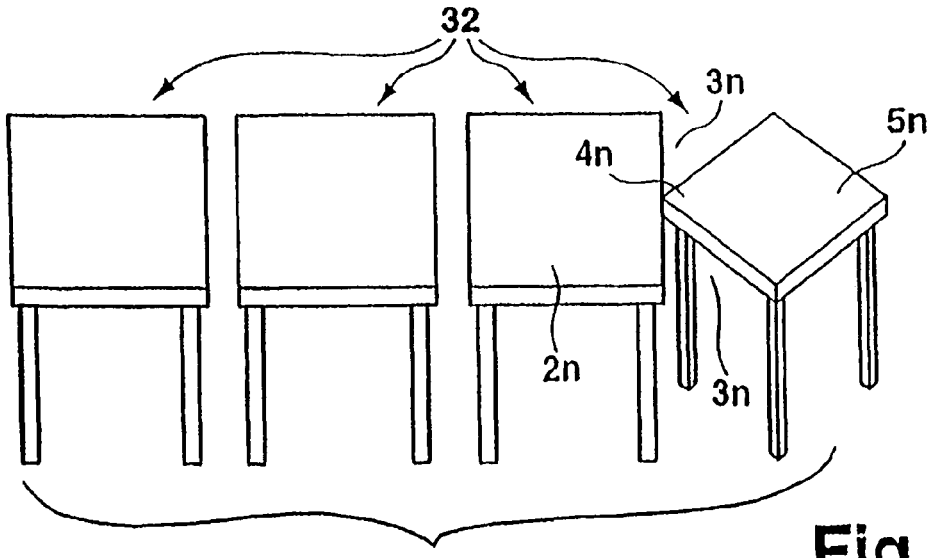
FIG. 23 shows a further furniture arrangement positionable relative to one another in a supporting position for its additional function as supporting device.

In the embodiment according to FIG. 23, a furniture arrangement 32 is provided in the form of square tables or stools which are not interconnected. Such tables or stools are known in principle. In the embodiment according to FIG. 23, however, these are positioned in the form of a supporting device, the last stool or table similar to the design according to FIG. 22 is turned through 45° and has a corner joined to the adjacent stool or table. All the tables or stools have the same height. In this way, the edge table or stool forms the head support section 5*n* including the support surface 4*n* for the spinal column with corresponding recesses 3*n*, and the adjacent stool or table forms the back support section 2*n*.

Figure 24:
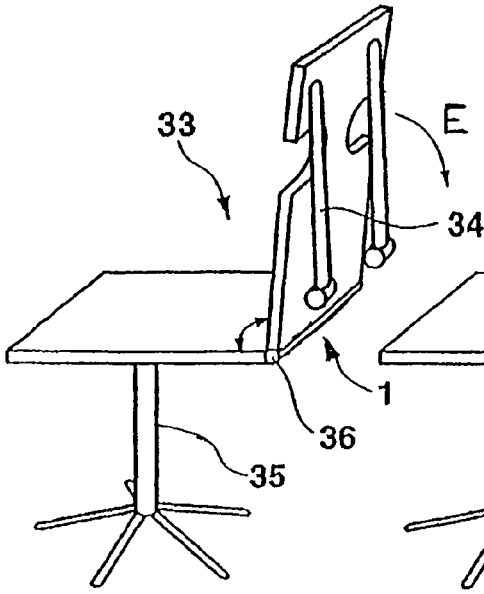
FIGS. 24 and 25 show an office chair provided with an additional function as supporting device.
Figure 25:
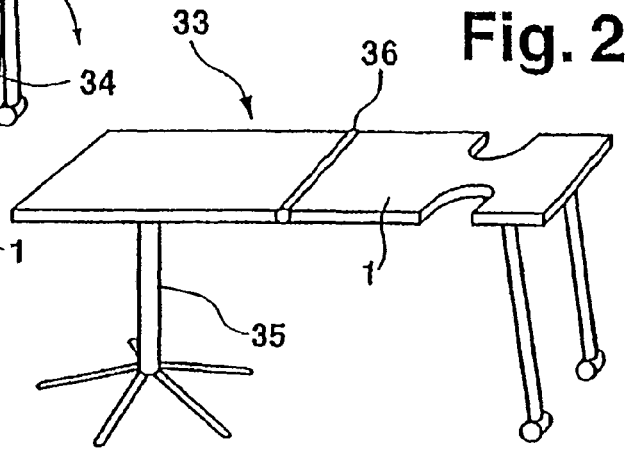

In the embodiment according to FIGS. 24 and 25, a mobile item of furniture is provided, in the present instance in the form of an office chair 33 on a pedestal 35, having a backrest which serves as support unit 1. The backrest can be lowered into a horizontal supporting position according to FIG. 25, as indicated by the directional arrow E. The hinge arrangement 36 serves for this purpose. To permit secure holding of the support unit 1 in the supporting position, support legs 34 are provided which, in the present embodiment, are mounted so that they can be folded into and out of the backrest. It is also possible to provide separate support elements for holding the support unit 1 in its supporting position.

Figure 26:
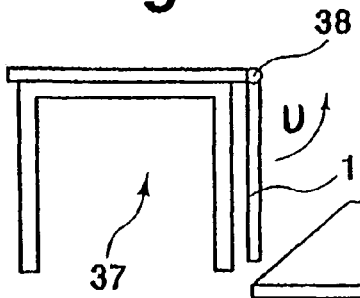
FIGS. 26 and 27 show a further table arrangement serving, in an additional function, as a supporting device.
Figure 27:
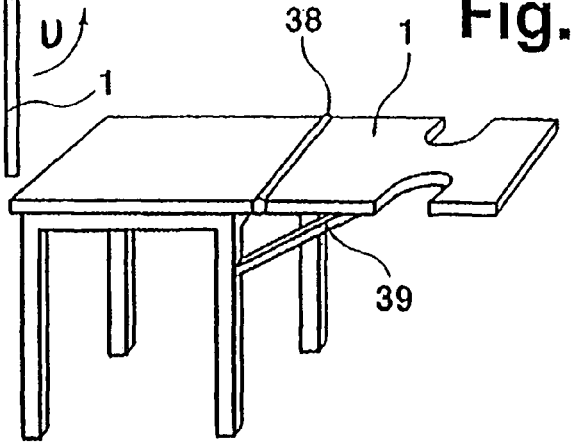

In the embodiment according to FIGS. 26 and 27, a table arrangement 37 is provided which is additionally provided with a support unit 1 articulated on an outer edge of a table top of the table arrangement 37 by means of a hinge arrangement 38. In this way, the support arrangement 37 can serve as supporting device as soon as the support unit 1 is pivoted upward into its horizontal supporting position, as indicated by the directional arrow U. In its horizontal supporting position, the support unit 1 is secured by at least one corresponding support element 39 (shown only in FIG. 27).

All the embodiments described above are shown only schematically. Dimensions and proportions of individual parts or sections in the drawings do not necessarily correspond to practical configurations. The corresponding support sections, support units or supporting devices can thus also have padded, unpadded, not flat, but curved or orthopedically shaped surfaces. The invention is therefore not limited to the described illustrative embodiments and instead also encompasses other designs obvious to a skilled person.

What is claimed is:

1. A supporting device for performing a stretching exercise of the muscles of the chest of a person, said supporting device comprising:

a horizontally elongate, rigid and board-shaped element configured for supporting the head and body of a person, said element having a substantially flat shape so as to be disposed entirely within a single plane, said element defining a longitudinal and centrally located axis and comprising:

a first support section defining a surface thereon configured for supporting a head of a person, said surface of said first support section having a width dimension defined transversely relative to the axis;

a second support section spaced longitudinally from said first support section and defining a surface thereon configured for supporting at least lower back and hip regions of the person, said surface of said second support section having a width dimension defined transversely relative to the axis; and a third bridging section extending longitudinally between and interconnecting said first support section and said second support section, said third bridging section having a central area disposed immediately adjacent and extending longitudinally along the axis, said central area defining a surface having a width dimension defined transversely relative to the axis, said width dimension of said central area being substantially less than said width dimensions of both said first support section and said second support section such that said third bridging section defines a pair of open areas on respective opposite sides of said central area configured for receiving respective shoulder blade areas of the person, said open areas being disposed longitudinally between said first support section and said second support section and being configured to open outwardly in opposite directions from one another in directions away from the axis, said width dimension of said central area being of a size for supporting substantially only a spinal column region of the person, each said open area having a width dimension extending transversely towards the axis from a point in longitudinal alignment with an adjacent outer longitudinal edge of said second support section to an adjacent outer longitudinal edge of said central area, said width dimension of each said open area being greater than said width dimension of said central area, each said open area being unobstructed outwardly in a direction substantially parallel to said plane of said element and unobstructed in a direction transverse to said plane to permit the respective shoulder blade areas and arms of the person, when lying on the back on said element, in respective outwardly extended positions generally parallel to said plane to move downwardly below said plane without meeting any substantial resistance from said element.

2. The supporting device of claim 1, wherein said width dimension of said second support section, longitudinally between a location on said second support section corresponding axially to the hip region of the person and a location on said second support section immediately axially adjacent the respective said open areas in which the shoulder blade areas are positioned, is of a dimension sufficient for fully supporting the width of the person's thoracic region while lying on the back on said element.

3. A longitudinally elongate supporting device for a person's back and head area, said device comprising:

a head support section defining a flat head support surface; and a back support section, said back support section defining a first flat support surface disposed at the level of shoulder blade areas of a person, and a second flat support surface, said first support surface being disposed between said head support surface and said second support surface, said head support surface and said first and second support surfaces all lying within a common horizontal plane, said first and second support surfaces each having a width dimension defined transversely relative to a longitudinal central axis of said supporting device and said second support surface having a longitudinal dimension defined parallel to the central longitudinal axis of said supporting device, said first support surface defining a pair of areas which open sidewardly outwardly on opposite sides of said back support section for receiving the respective shoulder blade areas of the person, each said area having an innermost edge defined by an outer longitudinal edge of said first support surface and located adjacent the central longitudinal axis, said width dimension of said first support surface being defined transversely between said innermost edges of said areas and being significantly less than said width dimension of said second support surface, said width dimension of said first support surface being sufficiently narrow so that said first support surface supports substantially only a spinal column region of the person and said areas being unobstructed sidewardly outwardly in a direction away from the central axis and being unobstructed downwardly in a direction transverse to the common plane to permit the respective shoulder blade areas and the arms of the person in respective sidewardly outwardly extended positions generally parallel to the common plane to move downwardly below the common plane without meeting any substantial resistance from said supporting device, said width dimension of said second support surface, longitudinally between a location on said second support surface corresponding axially to a hip area of a person and a location on said second support surface immediately axially adjacent the respective said areas in which the shoulder blade areas are positioned, being of a dimension sufficient for fully supporting the width of a person's thoracic region while lying on the back, said areas each having a maximum width dimension extending transversely between the respective said innermost edge to an outer extent in longitudinal alignment with an outer longitudinal edge of said second support surface, said width dimension of each said area being greater than said width dimension of said first support surface.

4. The supporting device of claim 3, wherein said head support section has a width dimension defined transversely relative to the longitudinal central axis of said supporting device, said width dimension of said head support section being greater than said width dimension of said first support surface.

* * * * *